US006959694B2

(12) United States Patent
Kieferle et al.

(10) Patent No.: US 6,959,694 B2
(45) Date of Patent: Nov. 1, 2005

(54) FUEL INJECTION SYSTEM FOR AN INTERNAL COMBUSTION ENGINE

(75) Inventors: Stefan Kieferle, Stuttgart (DE); Achim Koehler, Ditzingen (DE); Sascha Ambrock, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 328 days.

(21) Appl. No.: 10/420,765

(22) Filed: Apr. 23, 2003

(65) Prior Publication Data

US 2003/0213471 A1 Nov. 20, 2003

(30) Foreign Application Priority Data

Apr. 23, 2002 (DE) ..... 102 18 022

(51) Int. Cl.[7] ..... F04B 39/10
(52) U.S. Cl. ..... 123/446; 417/562
(58) Field of Search ..... 123/495, 446; 417/562, 569, 570

(56) References Cited

U.S. PATENT DOCUMENTS 6,457,957 B1 10/2002 Bauer et al.
6,558,142 B2 * 5/2003 De Matthaeis ..... 417/562
6,581,577 B1 6/2003 Geyer
6,764,286 B2 * 7/2004 Hunnicutt et al. ..... 417/470

FOREIGN PATENT DOCUMENTS

| | | |
|---|---|---|
| DE | 198 48 035 A1 | 4/2000 |
| DE | 199 41 850 A1 | 3/2001 |
| EP | 1 022 460 A2 | 7/2000 |
| WO | WO 95/25887 | 9/1995 |
| WO | WO 00/20753 | 4/2000 |

* cited by examiner

*Primary Examiner*—Thomas Moulis
(74) *Attorney, Agent, or Firm*—Ronald E. Greigg

(57) ABSTRACT

The fuel injection system has a high-pressure pump which pumps fuel into a reservoir to be supplied to injectors disposed at the engine cylinders. A feed pump supplies fuel to the high-pressure pump. The high-pressure pump has at least one pump element including a pump piston that defines a work chamber and is driven in a reciprocating motion; the work chamber has a communication with the compression side of the feed pump, in which an intake valve opening toward the work chamber is disposed, and through which valve fuel flows into the work chamber upon the intake stroke of the pump piston. The intake valve has a valve member, which is urged in a closing direction by a closing spring, and the closing spring is braced at least indirectly on the pump piston; with an increasing intake stroke of the pump piston, the closing force exerted on the valve member by the closing spring becomes less. A minimal opening differential pressure of the intake valve is less than 0.9 bar.

18 Claims, 3 Drawing Sheets

FUEL INJECTION SYSTEM FOR AN INTERNAL COMBUSTION ENGINE

BACKGROUND OF THE INVENTION

1. Field of the Invention

The invention is directed to an improved fuel injection system for an internal combustion engine.

2. Description of the Prior Art

One such fuel injection system, known from German Patent Disclosure DE 198 48 035 A1, has a high-pressure pump which is intended for a common rail injection system and in which fuel is pumped at high pressure into a reservoir by the high-pressure pump. Injectors disposed at the engine cylinders communicate with the reservoir. In common rail injection systems, a feed pump is typically provided, by which fuel is pumped out of a tank to the high-pressure pump. The high-pressure pump has a plurality of pump elements, each with one pump piston that defines a work chamber and is driven in a reciprocating motion. An intake valve opening into the work chamber opens upon the intake stroke of the pump piston, and fuel flows through it into the work chamber. The intake valve has a valve member, urged in a closing direction by a closing spring, and the closing spring is braced on a pump piston. The closing spring is compressed to its greatest extent by the piston at the onset of the intake stroke of the piston, so that the pressure at which the intake valve opens is higher than during the intake stroke of the pump piston, while during the intake stroke the closing spring is increasingly relaxed. Under certain engine operating conditions, especially overrunning, no fuel should be pumped into the reservoir by the high-pressure pump. To assure this, the opening differential pressure of the intake valve is set relatively high, for instance to at least 2 bar. However, the result is that the volumetric efficiency of the high-pressure pump is not optimal.

OBJECT AND SUMMARY OF THE INVENTION

The fuel injection system of the invention has the advantage over the prior art that the minimal opening differential pressure of the intake valve is very low, and thus the volumetric efficiency of the high-pressure pump is improved.

BRIEF DESCRIPTION OF THE DRAWINGS

The invention will be better understood and further objects and advantages thereof will become more apparent from the ensuing detailed description, taken in conjunction with the drawings, in which.

DESCRIPTION OF THE PREFERRED EMBODIMENTS

Figure 1:
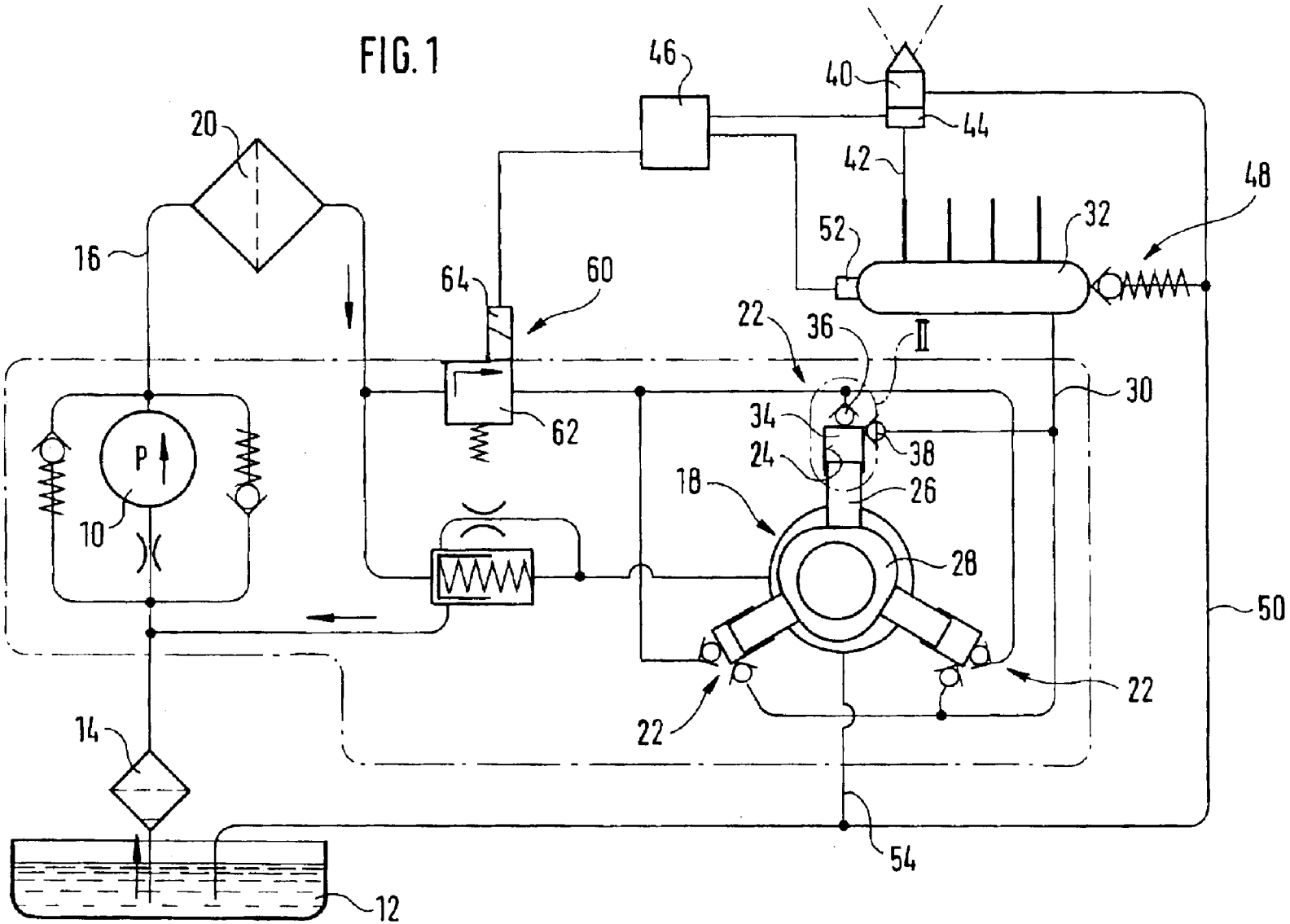
FIG. 1 schematically shows a fuel injection system for an internal combustion engine of a motor vehicle, having a high-pressure pump.

In FIG. 1, a fuel injection system for an internal combustion engine, for instance of motor vehicle, is shown. The engine is preferably a self-igniting engine and has one or more cylinders. The fuel injection system has a feed pump

10, which is disposed for instance in a fuel tank 12 of the motor vehicle but can also be disposed outside the tank 12. The feed pump 10 can have an electric drive motor, and for instance via a prefilter 14, it aspirates fuel from the fuel tank 12. The feed pump 10 can also be driven mechanically, for instance, by the engine. From the outlet of the feed pump 10, a line 16 leads to a high-pressure pump 18. A fuel filter 20, which is embodied as a fine filter and through which the fuel pumped by the feed pump 10 flows, is disposed in the line 16 between the feed pump 10 and the high-pressure pump 18.

The high-pressure pump 18 has more than one pump element 22, for instance, each of which has one pump piston 26 that is guided in a cylinder bore 24 and is driven in a reciprocating motion via an eccentric drive mechanism 28. The high-pressure pump 18 is driven preferably mechanically by the engine. The fuel pumped by the high-pressure pump 18 is delivered via a line 30 to a reservoir 32. Each pump element 22 has a work chamber 34, defined by the pump piston 26, into which an inlet from the feed pump 10 discharges and from which an outlet leads away to the reservoir 32. One intake valve 36 opening into the work chamber 34 is provided in the inlet of each pump element 22, and one pressure valve 38 opening toward the reservoir 32 is provided in the outlet of each pump element 22. In the intake stroke of the pump piston 26, when the pump piston is moving radially inward, the respective intake valve 34 opens, and fuel flows into the work chamber 34 from the feed pump 10, while the pressure valve 38 is closed. In the pumping stroke of the pump piston 26, when the pump piston is moving radially outward, the respective pressure valve 38 opens, and fuel flows out of the work chamber 34 to the reservoir 32, while the intake valve 36 is closed.

For each cylinder of the engine, one injector 40 is provided, through which fuel is injected into the combustion chamber of the cylinder. Each injector 40 communicates with the reservoir 32 via a line 42, and the opening of the injector 40 for fuel injection is controlled by an electrically triggered valve 44, which is triggered by an electronic control unit 46. From the injectors 40, a return 50 for fuel that is not injected can lead away to the fuel tank 12.

For controlling and/or limiting the pressure prevailing in the reservoir 32, a pressure valve 48 may be provided, which opens if a predetermined pressure is exceeded and opens a return to the fuel tank 12 from the reservoir 32 via the line 50. A pressure sensor 52 is also disposed on the reservoir 32; it detects the pressure in the reservoir 32 and is connected electrically to the control unit 46, to which a signal for the pressure prevailing in the reservoir 32 is thus supplied. A return 54 may be provided at the high-pressure pump 18, and by way of it a leakage quantity of fuel, for instance, can flow out and which can discharge into the line 50.

A fuel metering device 60, by which a flow cross section of the communication with the high-pressure pump 18 is adjusted, is disposed in the communication between the feed pump 10 and the high-pressure pump 18. The fuel metering device 60 is triggered by the control unit 46. The fuel metering device 60 has a flow regulating valve 62 and an actuator 64 that is triggered by the control unit 46. By means of the flow regulating valve 62, the flow cross section of the communication with the high-pressure pump 18 can be adjusted continuously between zero and a maximum flow cross section. As the actuator 64, an electromagnet or a piezoelectric actuator can be used, which is supplied with a defined electrical voltage by the control unit 46 and puts the flow regulating valve 62 into a defined position, in which this valve opens a defined flow cross section. Under certain engine operating conditions, especially overrunning, no fuel must be allowed to be pumped into the reservoir 32 by the high-pressure pump 18. To that end, the flow cross section from the feed pump 10 to the high-pressure pump 18 is closed completely by the fuel metering device 60, so that no further fuel flows to the high-pressure pump 18.

Depending on engine operating parameters, such as rpm, load, and others, a set-point pressure in the reservoir 32 is predetermined by the control unit 46. From the pressure sensor 52, the control unit 46 receives a signal for the actual pressure in the reservoir 32. The pressure in the reservoir 32 is dependent on the fuel quantity pumped into the reservoir 32 by the high-pressure pump 18. The fuel quantity pumped by the high-pressure pump 18 can be varied by providing that the flow cross section of the communication with the feed pump 10 is varied by means of the fuel metering device 60. The fuel metering device 60 is triggered by the control unit 46 in such a way it adjusts a large-enough flow cross section in the communication with the feed pump 10 that the quantity of fuel flowing to the high-pressure pump 18 is high enough that the fuel quantity pumped by the high-pressure pump 18 into the reservoir 32 suffices to maintain the predetermined set-point pressure in the reservoir 32. If the actual pressure in the reservoir 32 is less than the set-point pressure, then an excessively low fuel quantity is being pumped by the high-pressure pump 18, and the control unit triggers the fuel metering device 60 in such a way that it uncovers a larger flow cross section in the communication with the feed pump 10, so that the quantity of fuel pumped by the high-pressure pump 18 is increased. If the actual pressure in the reservoir 32 is higher than the set-point pressure, then an excessively large amount of fuel is being pumped by the high-pressure pump 18, and the fuel metering device 60 is triggered by the control unit 46 such that it opens a smaller flow cross section in the communication with the feed pump 10, thus reducing the quantity of fuel pumped by the high-pressure pump 18.

In conjunction with FIGS. 2 and 3, the intake valve 36 of a pump element 22 will now be described in further detail; all the pump elements 22 are embodied identically. In a housing part 70 of the high-pressure pump 18, an inlet conduit 72 is embodied for the fuel pumped by the feed pump 10 into the work chamber 34. At the orifice of the inlet conduit 72 into the work chamber 34, a valve seat 74 is embodied, toward the work chamber 34; the valve seat can for instance be embodied approximately conically. The intake valve 36 has a valve member 76, embodied for instance in the form of a ball, which cooperates with the valve seat 74 for controlling the communication of the inlet conduit 72 with the work chamber 34. The valve member 76 is for instance received in a carrier part 78 disposed toward the pump piston 26. The intake valve 36 also has a closing spring 80, which is embodied for instance as a helical compression spring and is fastened between the pump piston 26 and the carrier part 78. By means off the closing spring 80, the valve member 76 is pressed in the closing direction toward the valve seat 74. The valve member 76 is also urged in the closing direction by the pressure prevailing in the work chamber 34.

The pump piston 26, on its end toward the valve member 76, has a reduced-diameter extension 82; an annular shoulder 84 on which the closing spring 80 is braced is formed at the transition from the full diameter of the pump piston 26, where the pump piston is guided tightly in the cylinder bore 24, to the extension 82. The closing spring 80 surrounds the extension 82, and the carrier part 78 is embodied adjoining the extension 82. When the pump piston 26 is at top dead center, that is, the stroke position in which the pump piston 26 is located closest to the housing part 70, there is a spacing between the extension 82 of the pump piston 26 and the carrier part 78 in the direction of the longitudinal axis of the pump piston 26, when the valve member 76 is in its closing position, in which it rests on the valve seat 74. It can be provided that the face end of the extension 82 of the pump piston 26 forms a stop to limit the opening motion of the valve member 76 by causing the carrier part 78 to come to rest on the extension 82. When the pump piston 26 is at top dead center, as shown in FIG. 2, the closing spring 80 of the intake valve 36 is severely compressed and accordingly exerts a strong force on the valve member 76, with which this valve member is pressed against the valve seat 74. The force on the valve member 76 generated by the closing spring 80 and by the pressure prevailing in the work chamber 34 acts in the closing direction, counter to the force on the valve member 76 generated by the pressure prevailing in the inlet conduit 72. When the force on the valve member 76 generated by the pressure prevailing in the inlet conduit 72 is greater than the force on the valve member 76 effected by the closing spring 80 and the pressure prevailing in the work chamber 34, the valve member 76 moves in the opening direction, counter to the force of the closing spring 80, and opens the orifice of the inlet conduit 72 into the work chamber 34. The pressure at which the valve member 76 moves in the opening direction is called the opening differential pressure of the intake valve 36.

Figure 2:
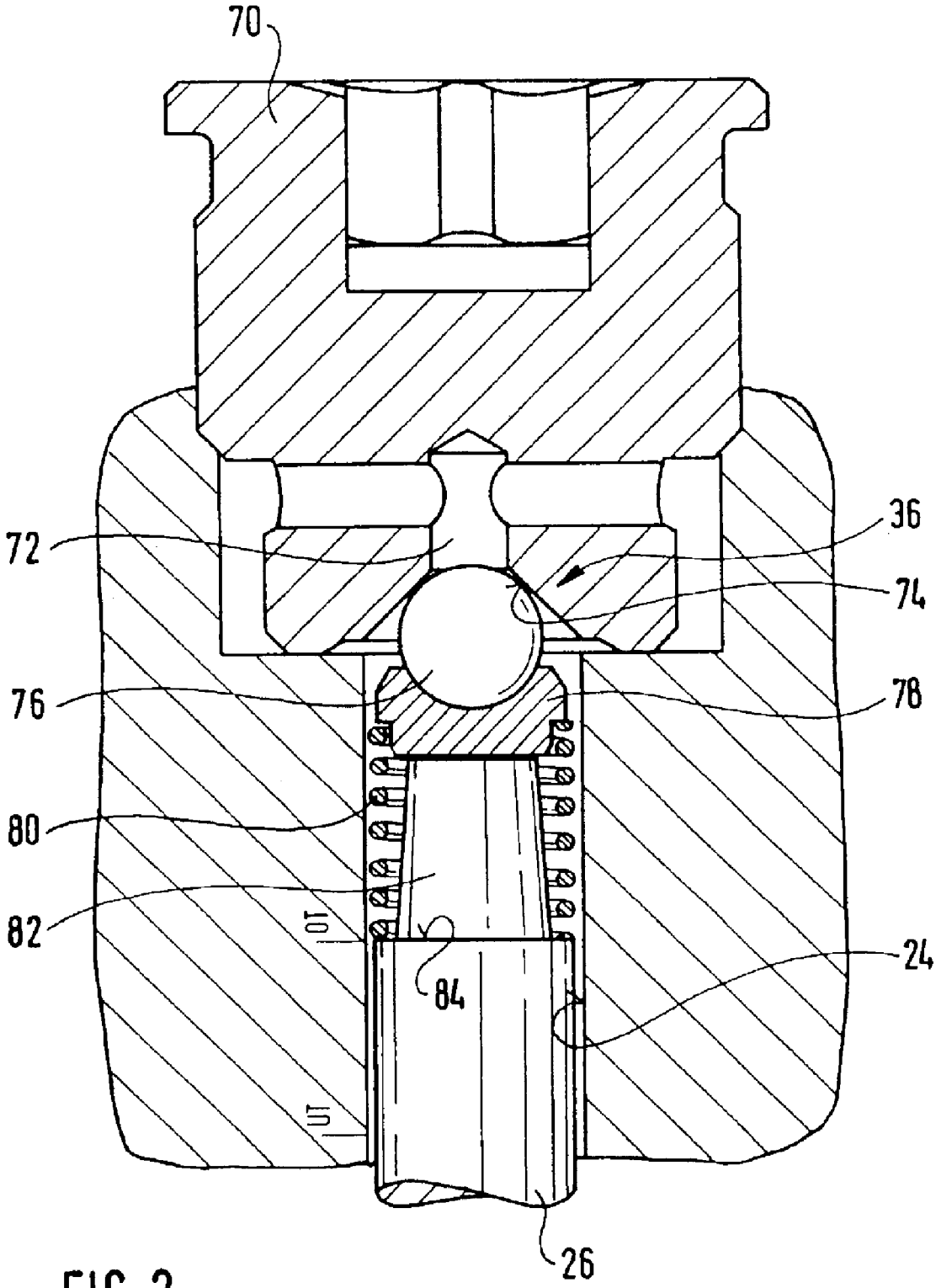
FIG. 2 shows an enlarged detail, marked II in FIG. 1, of the high-pressure pump with a pump piston at top dead center.
Figure 3:
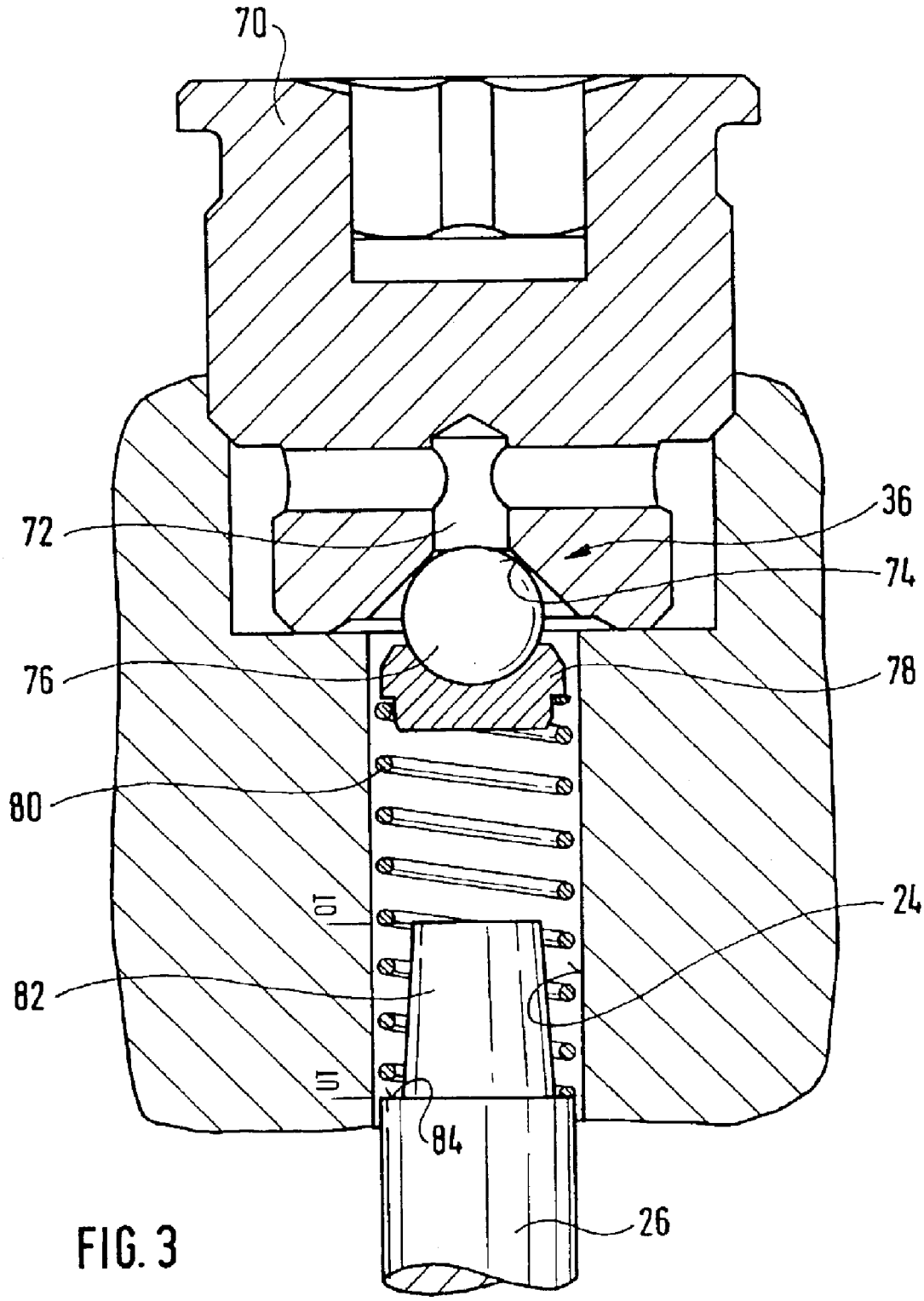
FIG. 3 shows the detail II with the pump piston at bottom dead center.

In the intake stroke, the pump piston 26 moves from its top dead center, shown in FIG. 2, to its bottom dead center, shown in FIG. 3. In the intake stroke of the pump piston 26, the closing spring 80 is increasingly relaxed, so that it exerts a lesser force in the closing direction on the valve member 76, and correspondingly the opening differential pressure of the intake valve 36 becomes less. When the pump piston 26, at the onset of the intake stroke, is at its top dead center, the opening differential pressure of the intake valve 36 is at its greatest and will hereinafter be called the maximal opening differential pressure. With an increasing intake stroke of the pump piston 26, the opening differential pressure decreases, and in one range of the medium intake stroke, that is, a middle stroke position of the pump piston 26 between its top dead center and bottom dead center, a medium opening differential pressure of the intake valve 36 is the result. When the pump piston 26 is at its bottom dead center, the opening differential pressure of the intake valve 36 is at its least and will hereinafter be called the minimal opening differential pressure. It is provided that the minimal opening differential pressure of the intake valve 36 is less than 0.9 bar and preferably is at most 0.8 bar. The medium opening differential pressure and the maximal opening differential pressure of the intake valve 36 are then dependent on the spring rate c of the closing spring 80, that is, the change in the force generated by it, refer to the spring travel, and on the stroke of the pump piston 26 between its top and bottom dead centers. The spring rate c of the closing spring 80 can have a low value, but the force on the valve member 76 exerted by the closing spring 80 changes substantially over the relatively long intake stroke of the pump piston 26. The medium opening differential pressure of the intake valve 36 is greater than 0.9 bar. The ratio between the medium opening differential pressure and the minimal opening differential pressure of the intake valve 36 is greater than 1 and at most is approximately 10.

Because the opening differential pressure of the intake valve 36 decreases during the intake stroke of the pump piston 26, secure opening of the intake valve 36 is attained even when the pressure in the fuel inlet conduit 72 is slight because of a small flow cross section, set by the fuel metering device 60, from the feed pump 10. This also assures that the intake valves 36 of all the pump elements 22 of the high-pressure pump 18 will open simultaneously, and thus uniform filling of the work chambers 34 of the all the pump elements 22 and thus uniform fuel pumping by the high-pressure pump 18 are also attained. By using a closing spring 80 with a low spring rate c, the influence of variations in the components of the high-pressure pump 18 on the opening pressure can be reduced, and thus an improvement in uniform fuel pumping by all the pump elements 22 can also be achieved. Moreover, by means of low medium and minimal opening differential pressure of the intake valve 36, the filling of the work chamber 34 can be improved, since the two parameters that are decisive for the filling, namely the pressure difference that is operative in filling upstream and downstream of the intake valve 36 and the opening duration of the intake valve 36, are great at a low opening differential pressure of the intake valve 36. On the other hand, for a given filling of the work chamber 34 of the pump elements 22, a feed pump 10 with a lesser pumping capacity and with a drive mechanism of correspondingly smaller dimensions can be used, making it more economical. Because the flow cross section from the feed pump 10 can be closed completely by means of the fuel metering device 60, zero pumping of the high-pressure pump 18 is assured even at only a slight opening differential pressure of the intake valve 36.

The foregoing relates to a preferred exemplary embodiment of the invention, it being understood that other variants and embodiments thereof are possible within the spirit and scope of the invention, the latter being defined by the appended claims.

What is claimed is:

1. In a fuel injection system for an internal combustion engine, having a high-pressure pump (18), by which fuel is pumped at high pressure into a reservoir (32) with which injectors (40) disposed on the cylinders of the engine communicate, having a feed pump (10), by which fuel is pumped from a tank (12) to the high-pressure pump (18), and the high-pressure pump (18) has at least one pump element (22) with a pump piston (26) that defines a work chamber (34) and is driven in a reciprocating motion, and the work chamber (34) has a communication with the compression side of the feed pump (10), in which communication an intake valve (36) opening toward the work chamber (34) is disposed, by which valve upon the intake stroke of the pump piston (26) fuel flows into the work chamber (34), and the intake valve (36) has a valve member (76), acted upon in a closing direction by a closing spring (80), and the closing spring (80) is braced at least indirectly on the pump piston (26), and with an increasing intake stroke of the pump piston (26), the closing force is exerted on the valve member (76) by the closing spring (80) becomes less, the improvement wherein a minimal opening differential pressure of the intake valve (36) amounts to less than 0.9 bar.

2. The fuel injection system according to claim 1, wherein the minimal opening differential pressure of the intake valve (36) is at most 0.8 bar.

3. The fuel injection system according to claim 1, wherein a medium opening differential pressure of the intake valve (36), in an intermediate position of the pump piston (26) in the range of half the intake stroke of the pump piston (26), is at least 0.9 bar.

4. The fuel injection system according to claim 2, wherein a medium opening differential pressure of the intake valve (36), in an intermediate position of the pump piston (26) in the range of half the intake stroke of the pump piston (26), is at least 0.9 bar.

5. The fuel injection system according to claim 3, wherein the ratio between the medium opening differential pressure and the minimal opening differential pressure of the intake valve (36) is greater than 1 and is at most 10.

6. The fuel injection system according to claim 4, wherein the ratio between the medium opening differential pressure and the minimal opening differential pressure of the intake valve (36) is greater than 1 and is at most 10.

7. The fuel injection system according to claim 1, further comprising a fuel metering device (60) disposed between the feed pump (10) and the intake valve (36), the fuel metering device (60) being operable to adjust and by which the flow cross section can be closed completely.

8. The fuel injection system according to claim 2, further comprising a fuel metering device (60) disposed between the feed pump (10) and the intake valve (36), the fuel metering device (60) being operable to adjust and by which the flow cross section can be closed completely.

9. The fuel injection system according to claim 3, further comprising a fuel metering device (60) disposed between the feed pump (10) and the intake valve (36), the fuel metering device (60) being operable to adjust and by which the flow cross section can be closed completely.

10. The fuel injection system according to claim 4, further comprising a fuel metering device (60) disposed between the feed pump (10) and the intake valve (36), the fuel metering device (60) being operable to adjust and by which the flow cross section can be closed completely.

11. The fuel injection system according to claim 5, further comprising a fuel metering device (60) disposed between the feed pump (10) and the intake valve (36), the fuel metering device (60) being operable to adjust and by which the flow cross section can be closed completely.

12. The fuel injection system according to claim 6, further comprising a fuel metering device (60) disposed between the feed pump (10) and the intake valve (36), the fuel metering device (60) being operable to adjust and by which the flow cross section can be closed completely.

13. The fuel injection system according to claim 7, wherein, by means of the fuel metering device (60), the flow cross section may be adjusted such that by the high-pressure pump (18) a quantity of fuel that is required to maintain a predetermined pressure in the reservoir (32) is pumped into the reservoir (32).

14. The fuel injection system according to claim 8, wherein, by means of the fuel metering device (60), the flow cross section may be adjusted such that by the high-pressure pump (18) a quantity of fuel that is required to maintain a predetermined pressure in the reservoir (32) is pumped into the reservoir (32).

15. The fuel injection system according to claim 9, wherein, by means of the fuel metering device (60), the flow cross section may be adjusted such that by the high-pressure pump (18) a quantity of fuel that is required to maintain a predetermined pressure in the reservoir (32) is pumped into the reservoir (32).

16. The fuel injection system according to claim 10, wherein, by means of the fuel metering device (60), the flow cross section may be adjusted such that by the high-pressure pump (18) a quantity of fuel that is required to maintain a predetermined pressure in the reservoir (32) is pumped into the reservoir (32).

17. The fuel injection system according to claim 11, wherein, by means of the fuel metering device (60), the flow cross section may be adjusted such that by the high-pressure pump (18) a quantity of fuel that is required to maintain a predetermined pressure in the reservoir (32) is pumped into the reservoir (32).

18. The fuel injection system according to claim 12, wherein, by means of the fuel metering device (60), the flow cross section may be adjusted such that by the high-pressure pump (18) a quantity of fuel that is required to maintain a predetermined pressure in the reservoir (32) is pumped into the reservoir (32).

* * * * *